US006152007A

United States Patent [19]

Sato

[11] Patent Number: 6,152,007

[45] **Date of Patent: *Nov. 28, 2000**

[54] SHEET CUTTER

[75] Inventor: Hitoshi Sato, Tokyo, Japan

[73] Assignee: Japan CBM Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/019,333

[22] Filed: Feb. 4, 1998

[30] Foreign Application Priority Data

| | | | |
|---|---|---|---|
| Feb. 5, 1997 | [JP] | Japan | 9-035705 |
| May 16, 1997 | [JP] | Japan | 9-141190 |
| Jul. 24, 1997 | [JP] | Japan | 9-212667 |

[51] Int. Cl.[7] ..... B26D 5/08

[52] U.S. Cl. ..... 83/582; 83/636; 83/202; 83/694; 83/628; 83/629; 83/631; 83/697; 83/602

[58] Field of Search ..... 83/563, 584, 568, 83/583, 602, 603, 616, 624, 628, 629, 631, 636, 821, 694, 856, 697, 202, 582

[56] References Cited

U.S. PATENT DOCUMENTS

| | | | |
|---|---|---|---|
| 3,286,568 | 11/1966 | Schutt et al. | 83/629 X |
| 3,772,955 | 11/1973 | Pearl | 83/746 |
| 4,624,164 | 11/1986 | Passa | 83/636 X |
| 4,651,609 | 3/1987 | Dobring et al. | 83/628 X |
| 4,936,177 | 6/1990 | Ozawa et al. | 83/628 X |
| 5,088,370 | 2/1992 | Kondo | 83/602 X |
| 5,105,703 | 4/1992 | Kondo | 83/636 |
| 5,206,679 | 4/1993 | Tahara et al. | 83/628 X |
| 5,235,887 | 8/1993 | Moriya | 83/628 X |
| 5,833,380 | 11/1998 | Hosomi et al. | 83/563 X |

FOREIGN PATENT DOCUMENTS

| | | | |
|---|---|---|---|
| 706200 | 3/1931 | France | 83/583 |
| 477536 | 6/1929 | Germany | 83/583 |

*Primary Examiner*—M. Rachuba
*Assistant Examiner*—Boyer Ashley
*Attorney, Agent, or Firm*—Dennison, Scheiner, Schultz & Wakeman

[57] ABSTRACT

A sheet cutter has a fixed blade and a movable blade. The fixed blade has a straight edge extending in a lateral direction with respect to a longitudinal direction of a sheet to be cut, and the movable blade is provided so as to be moved in the longitudinal direction. The movable blade has an edge on a side of a blade end portion extending in a direction making a first angle with the straight edge of the fixed blade. The edge of the movable blade is pressed against the edge of the fixed blade.

9 Claims, 13 Drawing Sheets

SHEET CUTTER

BACKGROUND OF THE INVENTION

The present invention relates to a sheet cutter for cutting a sheet such as a paper sheet, and a plastic film, which is used in a printer or a ticket issue machine for cutting a roll sheet into a sheet having a predetermined length.

Such a sheet cutter has a fixed blade and a movable blade. Either of the fixed blade and the movable blade has an inverted V-shaped edge, and the other blade has a straight edge. The movable blade is elastically deformed during the moving thereof and elastically engaged with the fixed blade by the restitutive power of the deformed blade during the cutting operation so as to cut the sheet. For example, Japanese Patent Publications 8-22517 and 8-5030 and Japanese Utility Model Publication 7-11907 disclose such sheet cutters.

FIG. 25 shows the sheet cutter disclosed in the Japanese Patent Publication 8-22517.

A movable blade 61 made of quenched carbon tool steel has a chevron-shaped (inverted V-shaped) edge 61*a* and is slidably attached to a frame 62 so as to be moved in the vertical direction. A fixed blade 63 is pivotally supported on the frame 62 by opposite shafts 64. A lever 67 is secured to a side of the fixed blade 64. A lower end of the lever 67 is connected to an end of a spring 65, so that an edge 63*a* is pressed against the movable blade 61.

As shown in FIG. 26, the edge 63*a* of the fixed blade 63 is curved to the movable blade to form an arcuated edge. Thus, an inside corner edge of the arcuated edge 63*a* is pressed against the side surface of the edge 61*a* of the movable blade 61.

A paper sheet (not shown) is inserted into a window 66 from the back side of the cutter by a predetermined length. The movable blade 61 is lowered so that the paper sheet is cut from the opposite sides thereof and the cutting is finished at a central tip end portion of the blade 61. Since the fixed blade has the arcuated edge 63*a*, both blades cut the sheet in the same manner as the scissors.

The Japanese Patent Publication 8-22517 further discloses a cutter, a movable blade of which has a V-shaped edge. The Japanese Patent Publication 8-5030 and Utility Model Publication 7-11907 also disclose sheet cutters similar to that of the Publication 8-22517.

Each of these sheet cutters has a chevron-shaped blade edge or a V-shaped blade edge in order to ensure the contact between the slidable blade and the fixed blade during the cutting operation.

If each of the slidable blade and fixed blade has a straight edge, the whole surface of the edge does not contact with the edge of the other blade over the whole span of the edge, because of the warp or wave of the board of the blade. In case that a space is formed between edges of both the blades, the sheet cannot be entirely cut or is broken. In order to prevent such a defective cutting operation, one of the blade edge is formed into a chevron shape or a V-shape so as to effect the scissors operation.

However, in order to accurately form the V-shaped edge into an optimum shape, the manufacturing cost increases. On the other hand, in order to keep the contact between the movable blade and the fixed blade, the contact pressure is increased, the consumption electric power increases and the blades quickly wear.

If one of the blades is made of a flexible thin plate so as to remove the above described defects, the thin plate may be deformed when a thick sheet is cut. Furthermore, the contact pressure of the thin plate decreases as the cutting points move to the opposite sides of the blade. As a result, it may occur that the sheet cannot be entirely cut at opposite sides.

SUMMARY OF THE INVENTION

An object of the present invention is to provide a sheet cutter which may exactly cut a sheet.

According to the present invention, there is provided a sheet cutter comprising a housing having an inlet opening and an outlet opening for inserting a sheet into the housing, a fixed blade having a straight edge extending in a lateral direction with respect to a longitudinal direction of the sheet, a movable blade provided in the housing so as to be moved in the longitudinal direction, the movable blade having an edge on a side of a blade end portion extending in a direction making a first angle with the straight edge of the fixed blade, pressing means for pressing the edge of the movable blade against the edge of the fixed blade, and a driving device for moving the movable blade in the longitudinal direction.

The blade end portion of the movable blade is inclined making a second angle with a surface of the fixed blade so that the edge of the movable blade is engaged with the edge of the fixed blade making the second angle with the surface of the fixed blade.

A guide portion is provided at an end portion of the movable blade for introducing the edge of the movable blade to the fixed blade edge.

The edge of the movable blade has a V-shape which is recessed in a body of the movable blade.

The body of the movable blade is inclined with respect to the surface of the fixed blade at a third angle ($\theta$).

A rib is formed along the edge of the movable blade, and the pressing means has a pressing end parallel to the straight edge of the fixed blade. A slide smoothing plate is disposed between the pressing end of the pressing means and the rib.

These and other objects and features of the present invention will become more apparent from the following detailed description with reference to the accompanying drawings.

DETAILED DESCRIPTION OF THE PREFERRED EMBODIMENT

Figure 1:
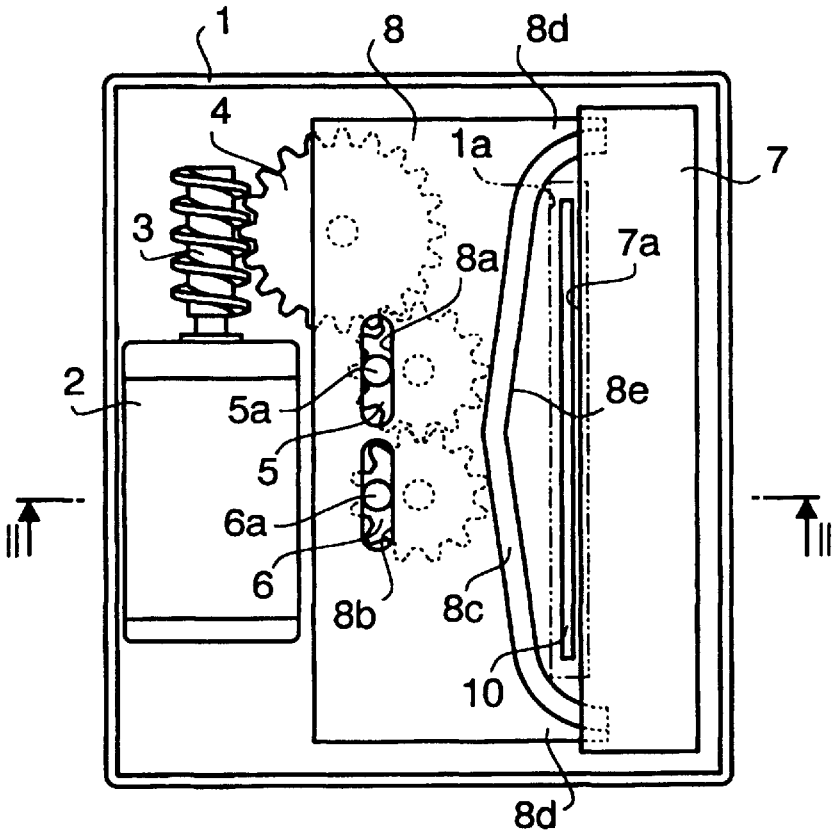
FIG. 1 is a plan view of a first embodiment of the present invention, a cover of which is removed.
Figure 2:
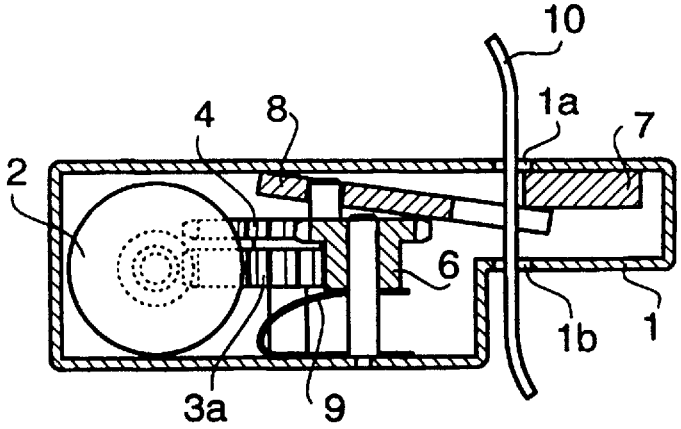
FIG. 2 is a sectional view taken along a line II—II of FIG. 1.
Figure 3:
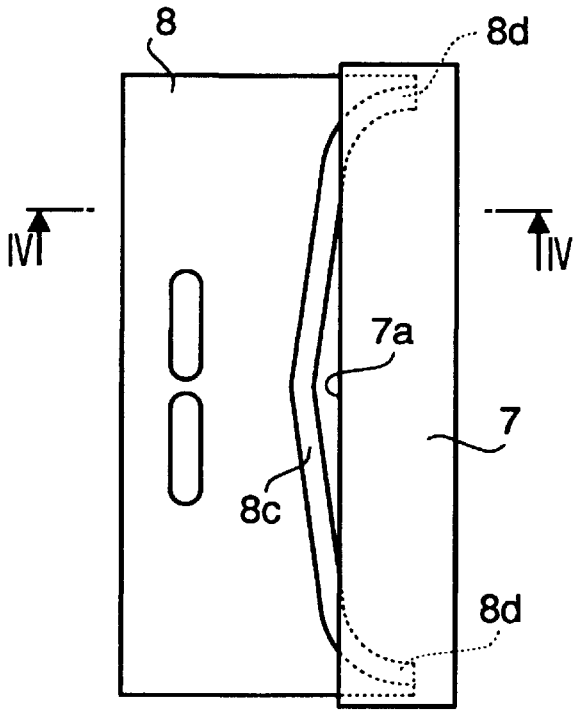
FIG. 3 is a plan view showing a movable blade and a fixed blade.

Referring to FIGS. 1 and 2, a housing 1 has an inlet opening 1*a* and an outlet opening 1*b* in upper and lower walls. In the housing, a motor 2 is installed. Securely mounted on a rotating shaft of the motor 2 is a worm 3 which is engaged with a worm wheel 3*a* rotatably mounted on a support shaft. A gear 4 integral with the worm wheel 3*a* engages with a movable blade driving first gear 5 which is engaged with a movable blade driving second gear 6 having the same number of teeth as the first gear 5. On the side surface of the first gear, a movable blade driving first pin 5*a* is mounted, and a movable blade driving second pin 6*a* is secured to the second gear.

In the housing 1 a fixed blade 7 having a straight edge 7*a* is securely mounted, and movable blade 8 is slidably mounted between the fixed blade 7 and the movable blade driving first and second gears 5 and 6.

The movable blade 8 has a pair of grooves 8*a* and 8*b* which are slidably engaged with the movable blade driving pins 5*a* and 6*a*, respectively. Therefore, when the driving first and second gears 5 and 6 rotate, the movable blade 8 is forwardly and rearwardly moved with respect to the fixed blade 7.

Figure 4:
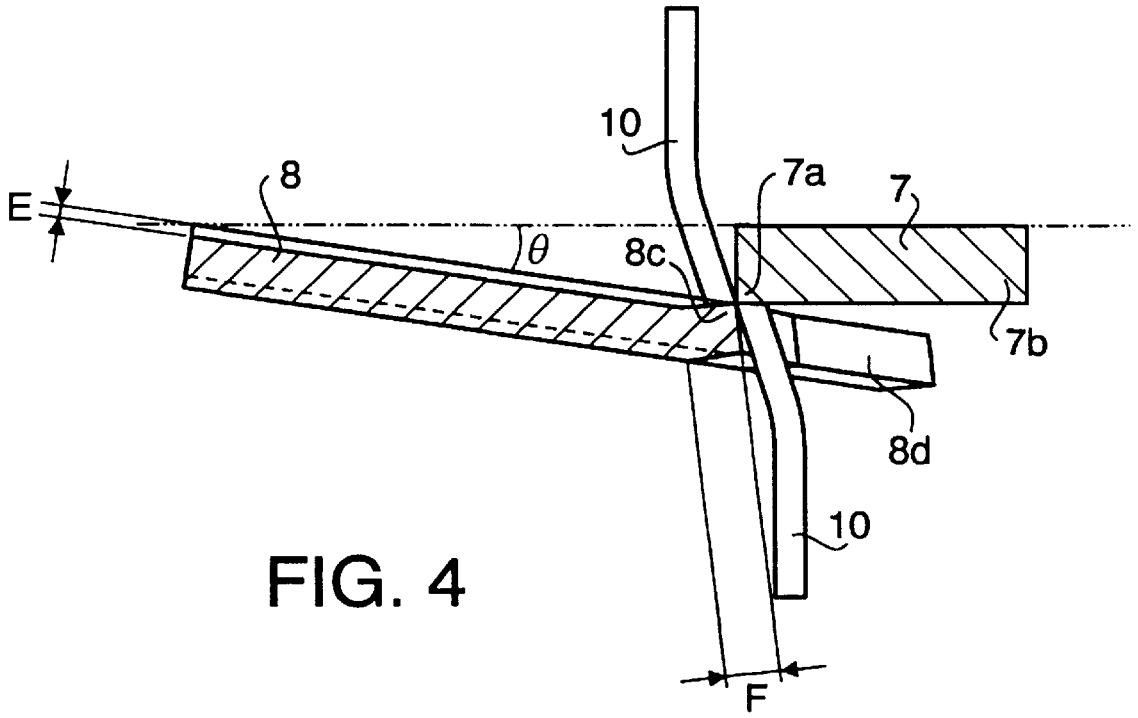
FIG. 4 is a sectional view taken along a line IV—IV of FIG. 3.

The movable blade 8 comprises a widely opened Vshaped recessed edge 8*e* and arcuated guide portions 8*d* at opposite sides of the edge 8*e*. The body of the movable blade 8 is inclined to make an angle θ with respect to an engaging surface 7*b* of the fixed blade, which has the edge 7*a* at the corner. The edge 8*e* is formed at the corner of a blade end portion 8*c* which is inclined toward the engaging surface 7*b* of the fixed blade 7 as shown in FIG. 4. Namely, in a movable blade having the length of the edge 8*e* of 9.3 mm, the blade end portion 8*c* is bent at a line, where the distance F from the edge 8*e* is about 1 mm, by the height E of 0.01 mm to 0.8 mm. The movable blade 8 is urged by a spring pressing plate 9 through gears 5 and 6 so that the edge 8*e* is elastically engaged with the straight edge 7*a* of the fixed blade 7. Thus, the both blades engage with each other in the same manner as the scissors. The movable blade 8 is slidably mounted on the guide portions 8*d* over the stroke of the movable blade 8.

In operation, a sheet 10 is inserted in the housing 1 passing through the inlet opening 1*a*, the space between blades 7, 8, and the front end of the sheet protrudes from the outlet opening 1*b* by a predetermined length. The motor 2 rotates the worm wheel 3*a* through the worm 3. The rotation of the worm wheel 3*a* causes the gears 5 and 6 to rotate through the gear 4. The driving pins 5*a* and 6*a* rotate in the reverse direction, so that the movable blade 8 is forwardly moved from the backward end position to the fixed blade 7. Thus, the sheet 10 is cut by the blades 7 and 8 at a predetermined position. Since the edge 8*e* engages with the edge 7*a* at an angle, the sheet is entirely cut even if the blades 7 and 8 have warps or waves. In addition, since the guide portion 8*d* is curved so as to be smoothly connected to the edge 8*e*, edge 8*e* of the movable blade 8 engages with the edge 7*a* of the fixed blade 7 without being checked by the end portion of the edge 7*a*.

Figure 5:
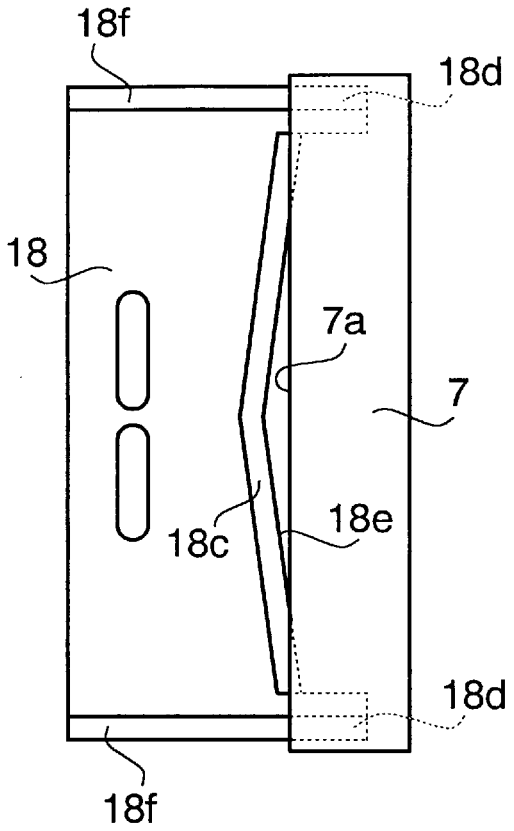
FIG. 5 is a plan view showing a movable blade and a fixed blade of a second embodiment of the present invention.
Figure 6:
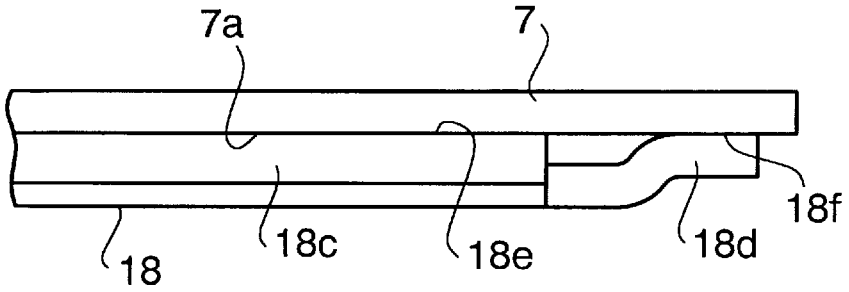
FIG. 6 is an enlarged side view of a part of FIG. 5 as viewed from the right side thereof.

Referring to FIGS. 5 and 6 showing the second embodiment of the present invention, the same parts as the first embodiment are identified by the same reference numerals as FIGS. 1 to 4, and the description thereof is omitted.

In the first embodiment, the guide portion 8*d* is continuously formed to the blade end portion 8*c*. In the second embodiment, a guide portion 18*d* is separated from a blade end portion 18*c*, and a side end portion of a movable blade 18 is upwardly bent as shown in FIG. 6 by a height slightly lower than the height E of the blade end portion 18*c* to form a guide face 18*f*.

When the movable blade 18 is positioned at a rear end portion, the guide face 18*f* engages with the underside of the fixed blade 7. Therefore, when the movable blade 18 is forwardly moved, the blade smoothly transfers from the guide portions 18*d* to an edge 18*e*.

Figure 7:
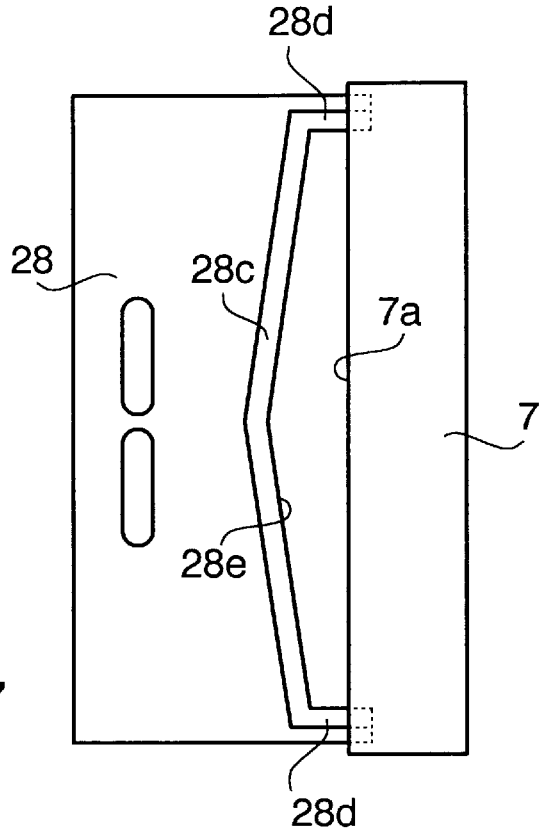
FIG. 7 is a plan view showing a movable blade and a fixed blade of a third embodiment of the present invention.

Referring to FIG. 7 showing the third embodiment of the present invention, a movable blade 28 comprises a blade end portion 28*c* having a V-shaped edge 28*e*, and a pair of guide portions 28*d*. The guide portion 28*d* makes 90 degree with the edge 7*a* of the fixed blade. Other construction and operation are the same as the first embodiment.

Figure 8:
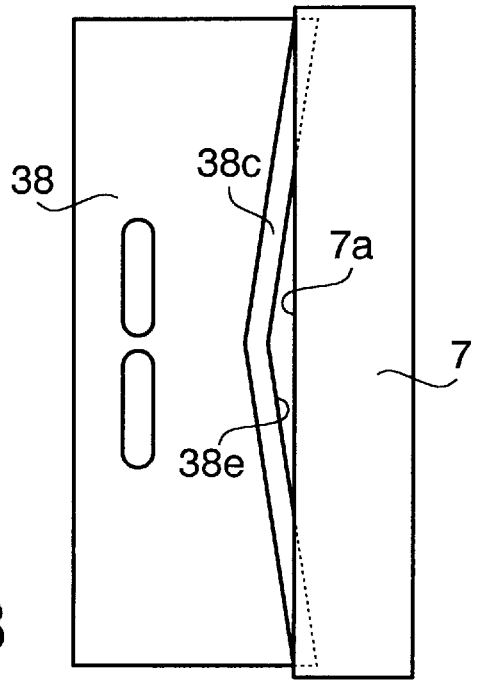
FIG. 8 is a plan view showing a movable blade and a fixed blade of a fourth embodiment of the present invention.

Referring to FIG. 8 showing the fourth embodiment of the present invention, there is not provided with guide portions 8*d* in the previous embodiments. Therefore, a movable blade 38 comprises an inclined blade end portion 38*c* and a V-shaped recessed edge 38*e* at the corner of the blade end portion 38*c*.

Although guide portions are not provided at opposite ends of the movable blade 38, the operation and advantages are substantially the same as the previous embodiments.

Figure 9:
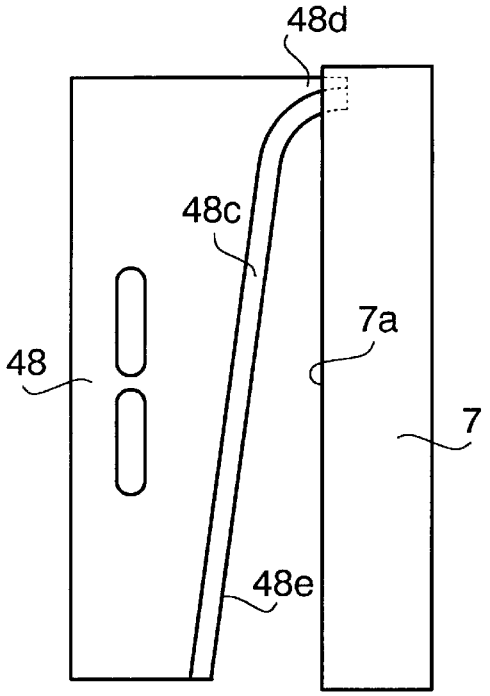
FIG. 9 is a plan view showing a movable blade and a fixed blade of a fifth embodiment of the present invention.

FIG. 9 shows the fifth embodiment of the present invention.

A movable blade 48 comprises a single inclined blade end portion 48*c* which is backwardly inclined to one of the side edges, edge 48*e* and an arcuated guide portion 48*d* at the other side edge in the same manner as the first embodiment.

Figure 10B:
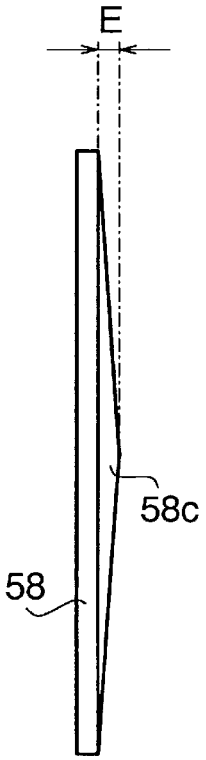
FIG. 10*b* is a side view of the movable blade of FIG. 10*a;*
Figure 10A:
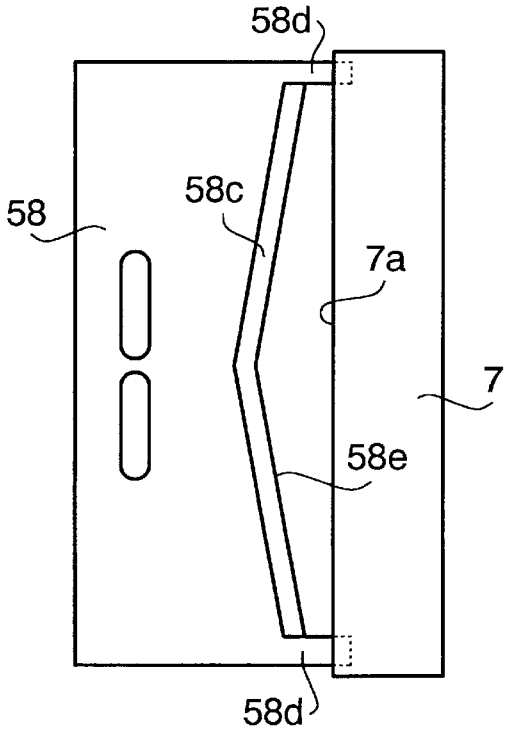
FIG. 10*a* is a plan view showing a movable blade and fixed blade of a sixth embodiment of the present invention.

Referring to FIGS. 10*a* and 10*b* showing the sixth embodiment of the present invention, a movable blade 58 has a V-shaped inclined blade end portion 58*c* having an edge 58*e*, and a guide portion 58*d* at each side edge of the movable blade. The guide portion 58*d* is not inclined so that the height of the guide portion is the same as the body of the movable blade 58. The height of the inclined blade end portion 58*a* is gradually reduced from the center of the blade, which has the height E, to the opposite guide portions 58*d* as shown in FIG. 10*b*. Namely, the contact pressure of the movable blade 58 to the fixed blade 7 increases as the contact points of both the blades go to the center.

Figure 11:
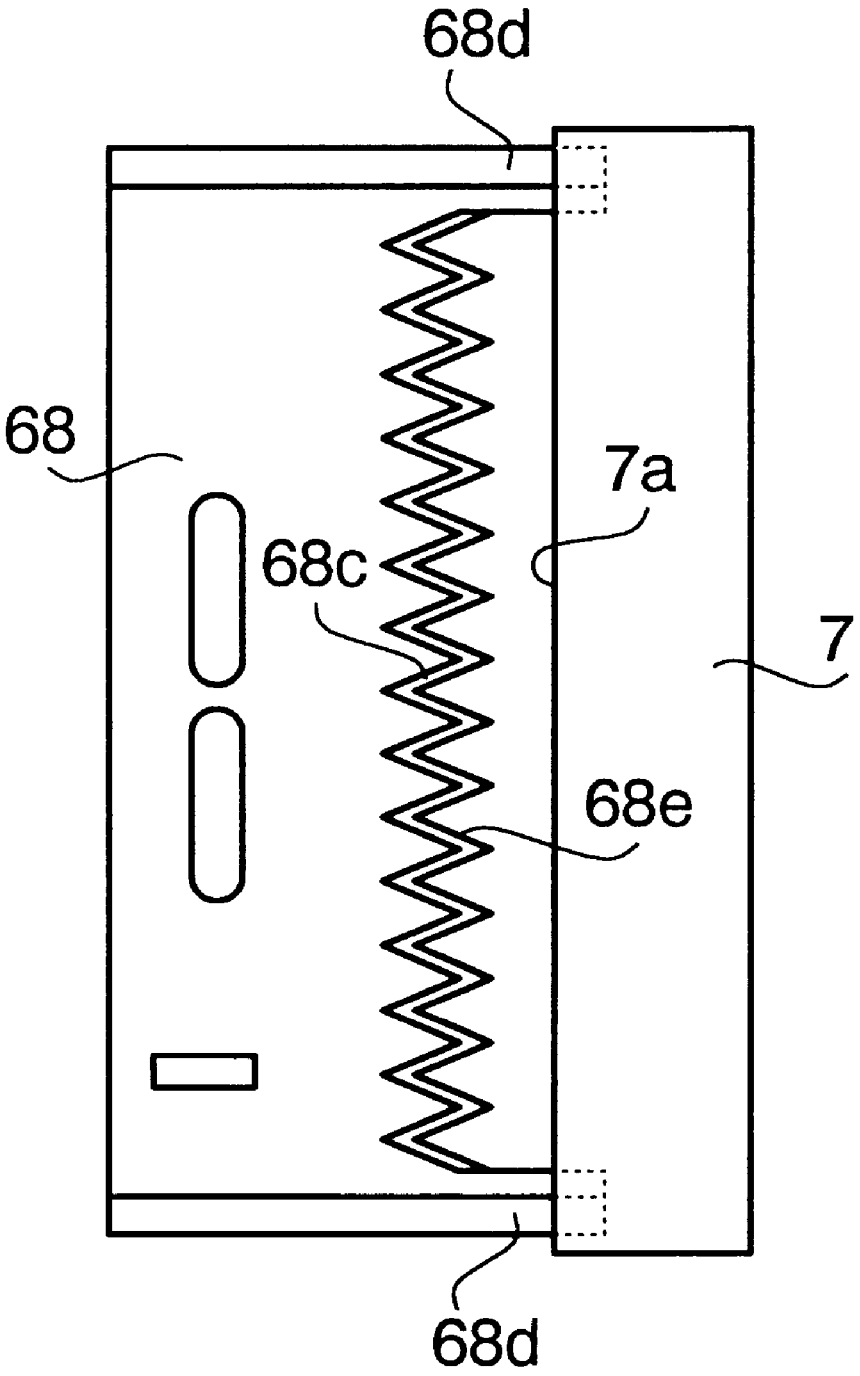
FIG. 11 is a plan view showing a movable blade and a fixed blade of a seventh embodiment of the present invention.

Referring to FIG. 11 showing the seventh embodiment of the present invention, a movable blade 68 comprises a saw-teeth shaped blade end portion 68*c* having an edge 68*e*, an opposite guide portions 68*d*.

When the movable blade 68 is stopped at a position before the stroke end, perforations are formed in the paper sheet. When the movable blade 68 is moved the entire stroke, the paper sheet is cut off.

Figure 12:
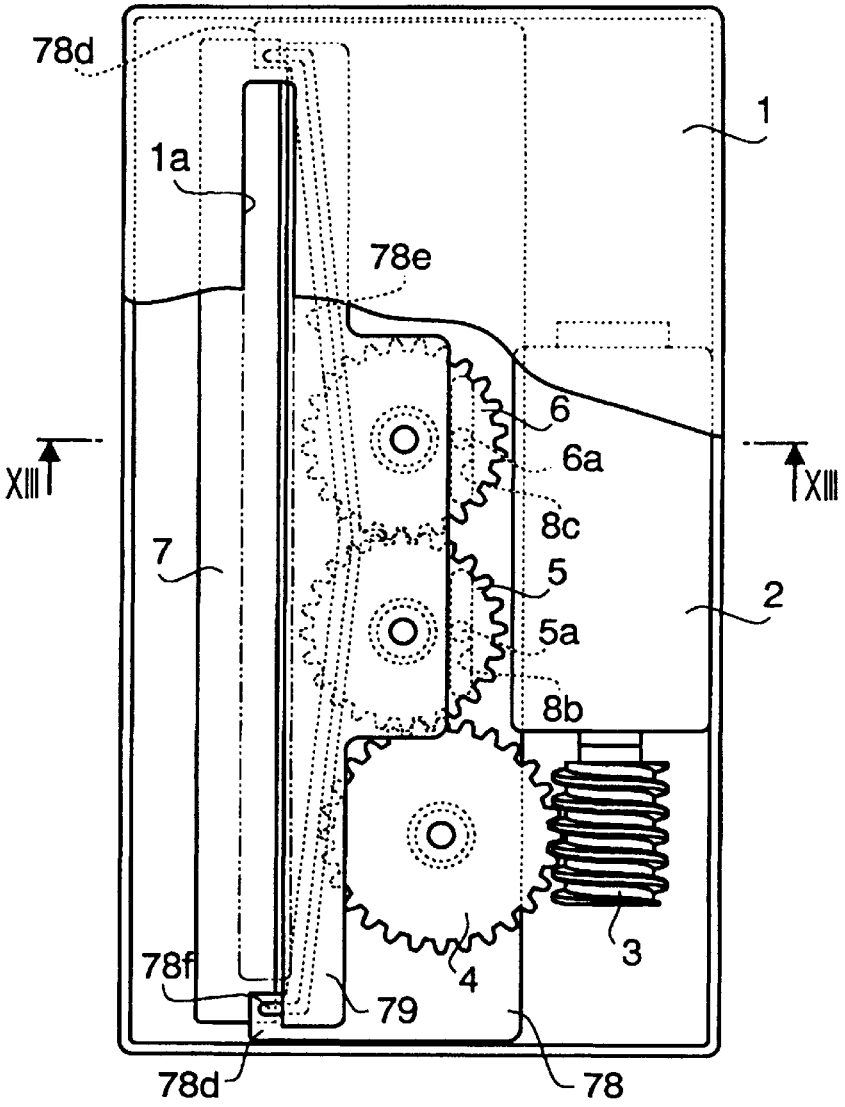
FIG. 12 is a plan view showing an eighth embodiment of the present invention.
Figure 13:
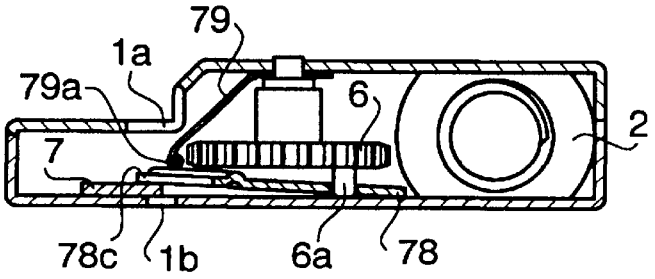
FIG. 13 is a sectional view taken along a line XIII—XIII of FIG. 13.

FIGS. 12 and 13 show the eighth embodiment of the present invention. The same parts as FIGS. 1 and 2 are identified by the same reference numerals as FIGS. 1 and 2.

Figure 14:
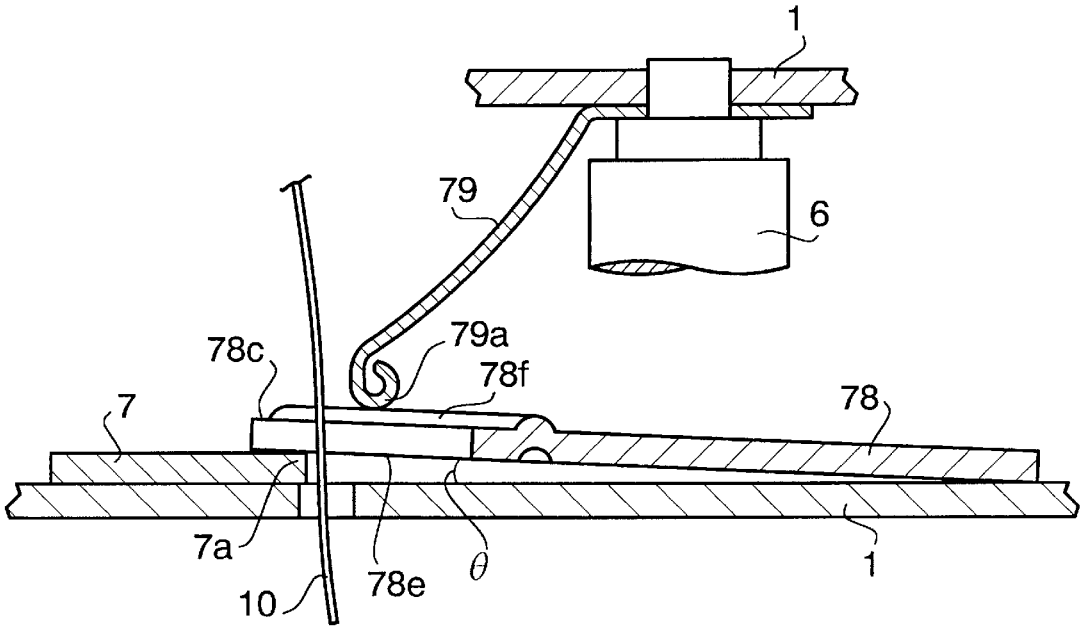
FIG. 14 is a sectional side view.
Figure 15:
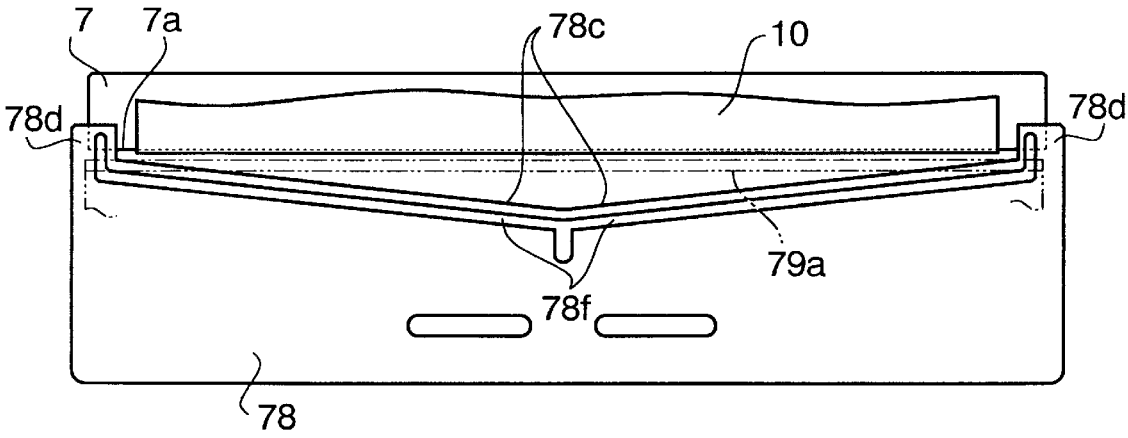
FIG. 15 is a plan view showing a movable blade and a fixed blade of the eighth embodiment of the present invention.

A movable blade 78 comprises a blade end portion 78*c* having a V-shaped edge 78*e* and opposite guide portions 78*d*. In the eighth embodiment, as shown in FIGS. 14 and 15, a V-shaped rib 78*f* is formed on the underside of the blade along the V-shaped edge 78*e*, projected from the underside. The blade end portion 78*c* is not bent towards the fixed blade 7 unlike the previous embodiments. A pressing end 79*a* of a spring pressing plate 79 is pressed against the rib 78*f*. The pressing end 79*a* has a straight contact face parallel to the edge 7*a* of the fixed blade 7 as shown in FIG. 15. The rib 78*f* is located at a distance to 1 to 3 mm from the edge 78*e* and projected at a height of 0.1 to 0.3 mm. The pressing end 79*a* is positioned at a distance of 1 to 3 mm from the edge 7*a*. Thus the edge 78*e* of the movable blade 78 is pressed against the edge 7*a* of the fixed blade.

The pressing end 79*a* may be formed with a plastic having a small coefficient of friction and a high abrasion resistance.

When the movable blade 78 is forwardly moved, the engaging point of the edge 78*e* with the edge 7*a* of the 15 fixed blade 7 of the fixed blade 7 moves from the opposite sides of the blades 78 and 7 to a central position of the blade.

Figure 16:
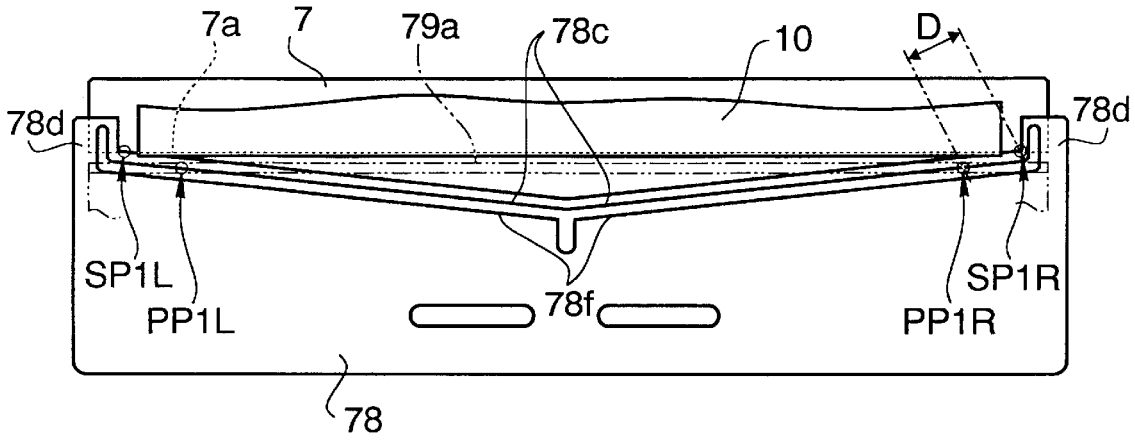
FIGS. 16 to 18 are plan views showing operation of the movable blade and the fixed blade.

FIG. 16 shows a condition when the edge 78*e* of the movable blade 78 begins to engage with the edge 7*a* of the fixed blade 7 at right and left engaging pints SP1R and SP1L. On the other hand, the pressing end 79*a* of the pressing plate 79 engages with the rib 78*f* at right and left pressing points PP1R and PP1L. The pressing points, for example the right pressing point PP1R is very close to the engaging point SP1R at a small distance D. The distance D is the same at the left side. Thus, the edge 78*e* of the movable blade 78 is pressed against the edge 7*a* of the fixed blade at a large pressing force.

Figure 17:
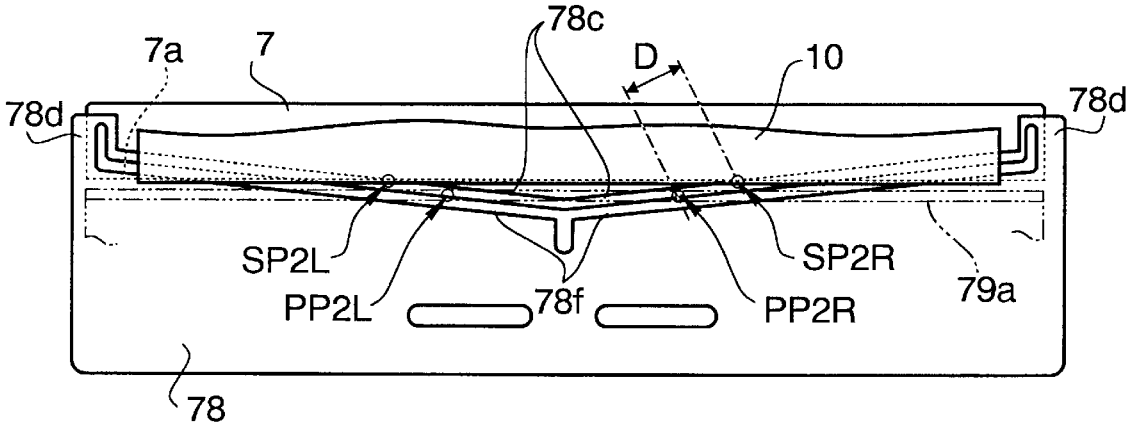
Figure 18:
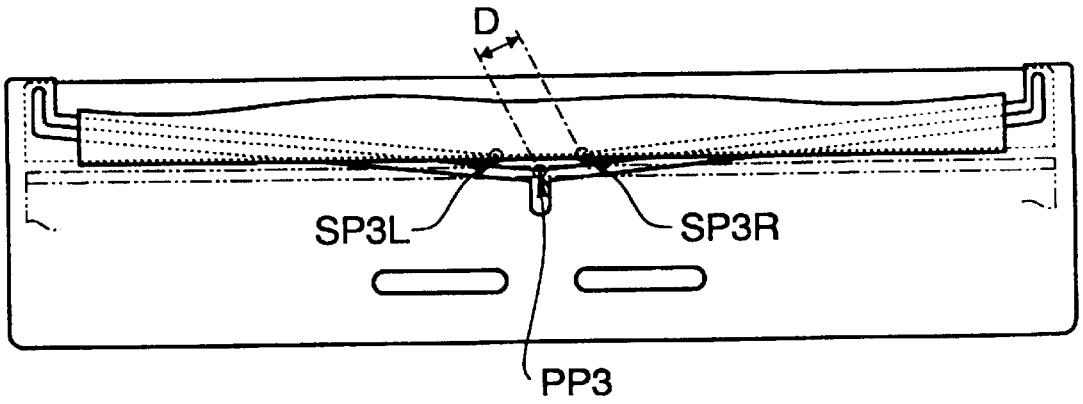

As shown in FIGS. 17 and 18, as the movable blade 78 moves forward, the engaging points SP2R, SP2L, SP3R and SP3L and the pressing points PP2R, PP2L, PP3R and PP3L move to the center of the cutter at the same distance D there-between. Thus, the edge 78*e* is engaged with the edge 7*a* at the same large pressing force. Therefore, the sheet 10 is perfectly cut without breaking or tearing.

Figure 19:
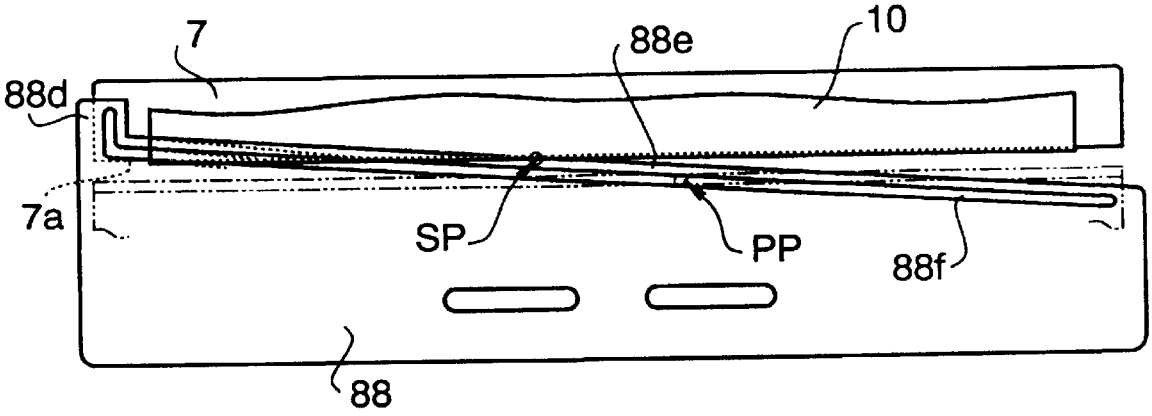
FIG. 19 is a plan view showing a ninth embodiment of the present invention.

FIG. 19 shows the ninth embodiment of the present invention. A movable blade 88 has an edge 88*e* which is inclined to only one side, a single guide portion 88*d*, and a rib 88*f* parallel to the edge 7*a* of the fixed blade 7. A single engaging point SP and a single pressing point PP move to the right as the movable blade 88 is forwardly moved. This embodiment has the same effect the previous embodiment.

Figure 20:
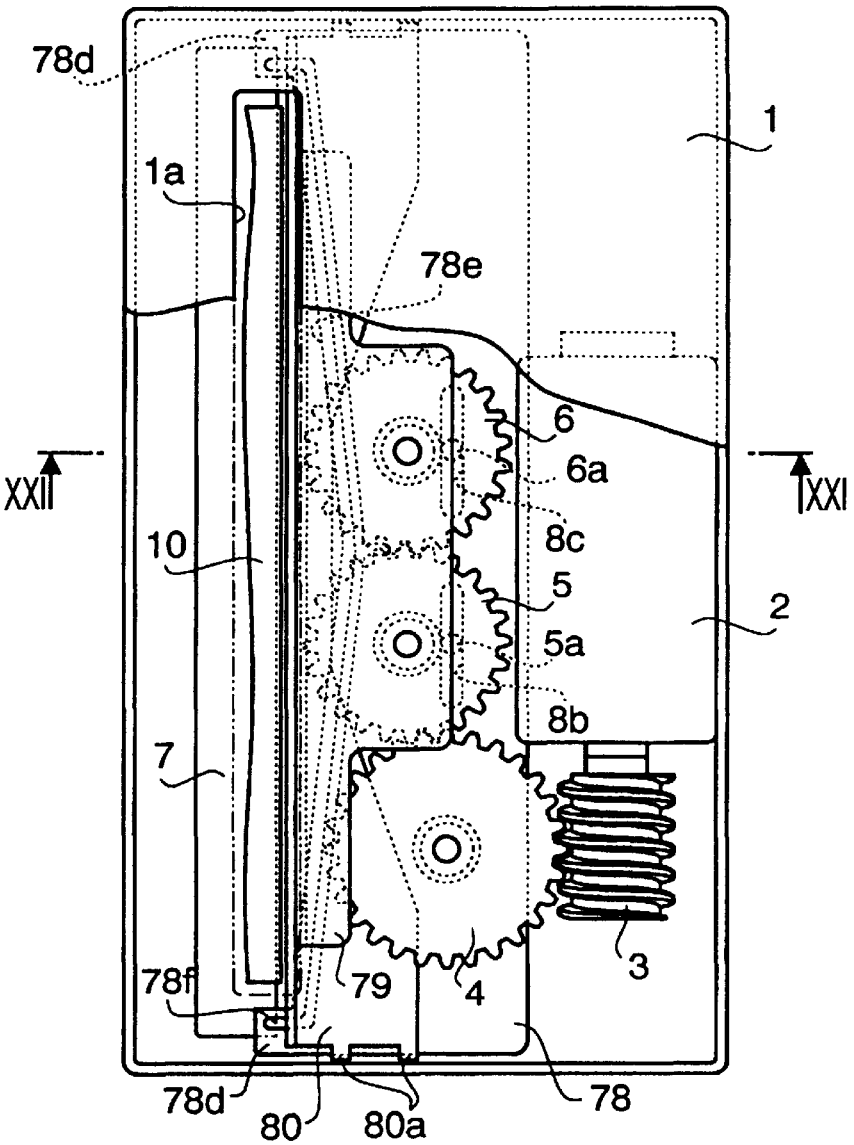
FIG. 20 is a plan view showing a tenth embodiment of the present invention.
Figure 21:
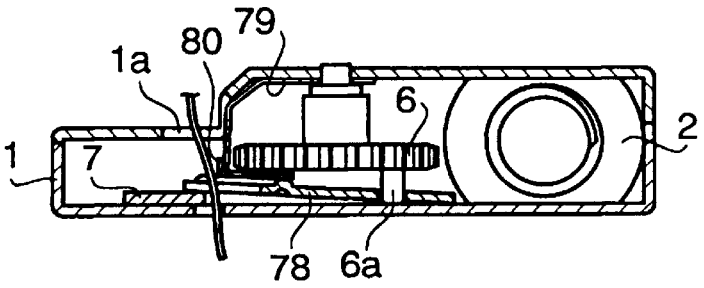
FIG. 21 is a sectional view taken along a line XXI—XXI of FIG. 20.

Referring to FIGS. 20 and 21 showing the tenth embodiment of the present invention, the same parts as those of FIGS. 12 and 13 are identified as the same reference numerals as FIGS. 12 and 13, and hence the description for the parts is omitted.

Figure 22:
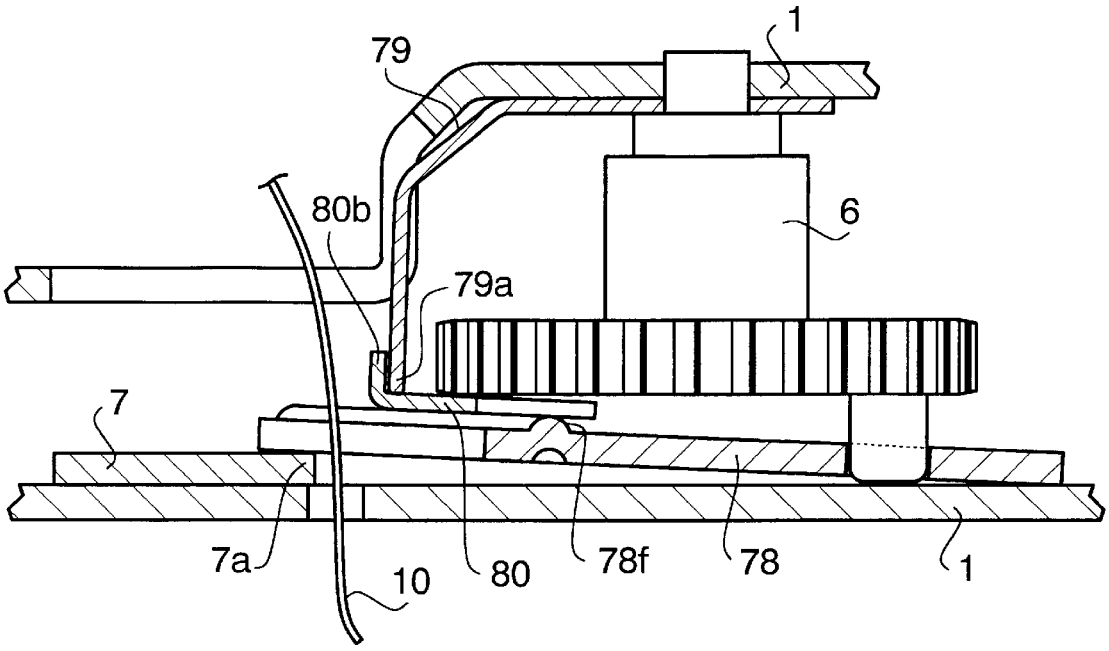
FIG. 22 is a sectional side view.
Figure 23:
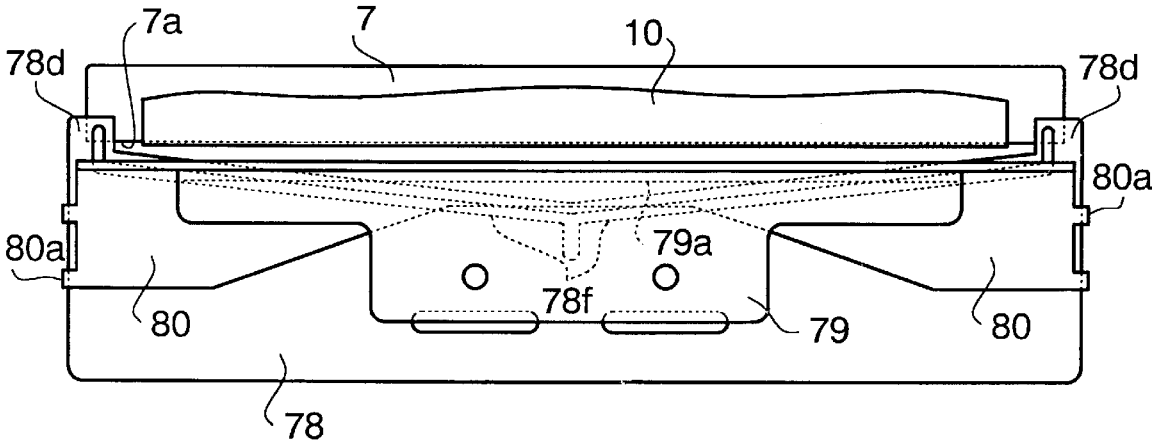
FIG. 23 is a plan view showing a movable blade and a fixed blade.

As shown in FIG. 22, a slide smoothing plate 80 is disposed between the pressing end 79*a* of the pressing plate 79 and the rib 78*f*. The slide smoothing plate 80 is securely mounted on side walls of the housing 1 by lugs 80*a* each of which is projected form the side of the plate 80 in an L-shape form. The slide smoothing plate 80 has an L-shaped projection 80*b*, and the pressing end 79*a* engages with the corner of the projection 80*b*.

Figure 24:
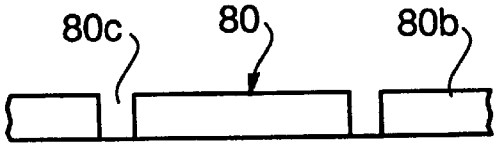
FIG. 24 is a front view of a part of a slide smoothing plate.
Figure 25:
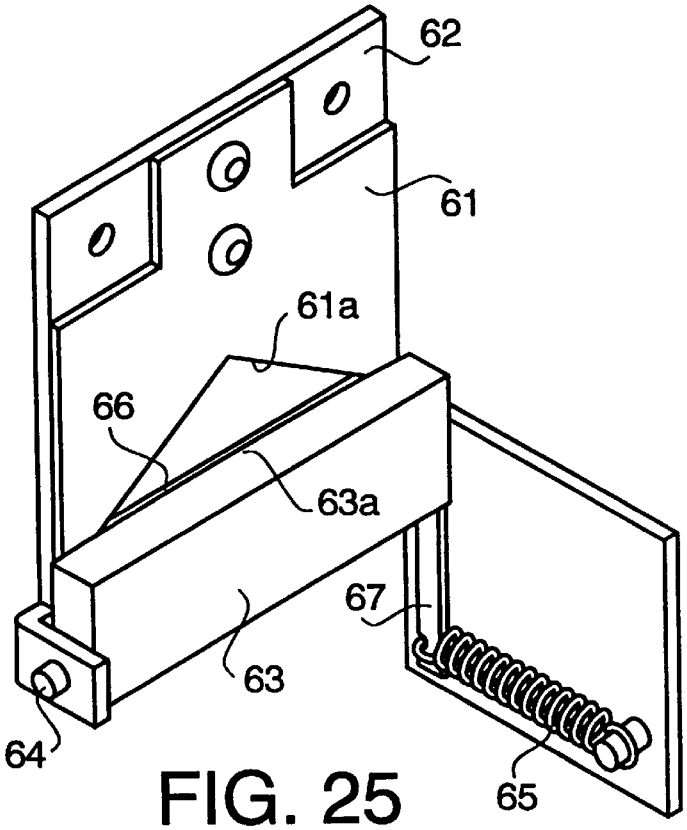
FIG. 25 PRIOR ART
FIG. 25 is a perspective view showing a conventional sheet cutter.
Figure 26:
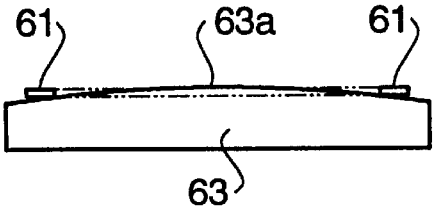
FIG. 26 PRIOR ART
FIG. 26 is a plan view of a fixed blade.

As shown in FIG. 24, there are provided a plurality of notches 80*c* in the projection 80*b*, so that the slide smoothing plate 80 can be bent in accordance with waves of the surface of the rib 80*f*.

Thus the movable blade 78 can be smoothly moved by the side of the slide smoothing plate 80. Since the pressing end 79*a* engages with the inside wall of the projection 80*b*, the pressing plate 79 is not vibrated. Therefore, noises do not generate.

While the invention has been described in conjunction with preferred specific embodiment thereof, it will be understood that this description is intended to illustrate and not limit the scope of the invention, which is defined by the following claims.

What is claimed is:

1. A sheet cutter comprising:

a housing having an upper plate, and a lower plate, each having a sheet passing opening;

a fixed blade mounted on the lower plate and having a straight edge extending in a first direction perpendicular to a paper feedinq direction;

a movable blade having an oblique edge formed on a first side extending in a direction making a first angle with the straight edge of the fixed blade, a flexible rib formed on the movable blade in parallel with the edge of the movable blade by bending the movable blade in sectional shape of an inverted U-shape;

the movable blade being supported on the straight edge of the fixed blade at the oblique edge and on the lower plate at a second side opposite to the first side so that the movable blade is held in an inclined condition;

pressing means mounted in said housing and having a pressing end parallel to the straight edge of the fixed blade, so that the pressing end intersects with the rib of the movable blade for pressing the edge of the movable blade against the edge of the fixed blade at the intersection; and, a driving device mounted in said housing for moving the movable blade toward and away from said fixed blade.

2. The sheet cutter according to claim 1 wherein the blade end portion of the movable blade is inclined making a second angle with a surface of the fixed blade so that the edge of the movable blade is engaged with the edge of the fixed blade making the second angle with the surface of the fixed blade.

3. The sheet cutter according to claim 1 further comprising a guide portion provided at an end portion of the movable blade for introducing the edge of the movable blade to the fixed blade edge.

4. The sheet cutter according to claim 1 wherein the edge of the movable blade has a V-shape which is recessed in a body of the movable blade.

5. The sheet cutter according to claim 1 wherein the edge of the movable blade comprises a single edge making the first angle.

6. The sheet cutter according to claim 1 wherein a body of the movable blade is inclined with respect to the surface of the fixed blade at a third angle (θ).

7. The sheet cutter according to claim 6 further comprising a slide smoothing plate disposed between the pressing end of the pressing means and the rib.

8. The sheet cutter according to claim 7 wherein the slide smoothing plate has an L-shaped projection, and the pressing end of the pressing means engages with a corner of the L-shaped projection.

9. The sheet cutter according to claim 8 wherein the L-shaped projection has a plurality of notches so as to give flexibility to the slide smoothing plate.

* * * * *